US010655894B2

(12) United States Patent
Lee et al.

(10) Patent No.: US 10,655,894 B2
(45) Date of Patent: May 19, 2020

(54) REFRIGERATION CYCLE OF REFRIGERATOR

(71) Applicant: LG ELECTRONICS INC., Seoul (KR)

(72) Inventors: Taehee Lee, Seoul (KR); Dongseok Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 382 days.

(21) Appl. No.: 14/533,183

(22) Filed: Nov. 5, 2014

(65) Prior Publication Data

US 2015/0121940 A1 May 7, 2015

(30) Foreign Application Priority Data

Nov. 5, 2013 (KR) ..... 10-2013-0133375

(51) Int. Cl.
*F25B 7/00* (2006.01)
*F25B 39/04* (2006.01)

(52) U.S. Cl.
CPC ..... *F25B 7/00* (2013.01); *F25B 39/04* (2013.01); *F25B 2400/06* (2013.01)

(58) Field of Classification Search
CPC ..... F25B 2500/01; F25B 39/04; F25B 2339/0445; F25B 7/00; F25B 2339/044;
(Continued)

(56) References Cited

U.S. PATENT DOCUMENTS 2,920,457 A * 1/1960 Bartlett, Jr. ..... F25B 9/04 62/115
3,287,924 A * 11/1966 Bright ..... F25B 5/02 55/399

(Continued)

FOREIGN PATENT DOCUMENTS

CN 2697535 5/2005
CN 102378892 3/2012

(Continued)

OTHER PUBLICATIONS

English translation of KR 20110071167 A.*

(Continued)

*Primary Examiner* — Elizabeth J Martin
*Assistant Examiner* — Melodee Jefferson
(74) *Attorney, Agent, or Firm* — Fish & Richardson P.C.

(57) ABSTRACT

Provided is a refrigeration cycle of a refrigerator. The refrigeration cycle of a refrigerator including a first refrigeration cycle in which a first refrigerant flows along a first refrigerant tube and a second refrigeration cycle in which a second refrigerant flows along a second refrigerant tube includes first and second compressors compressing each of the first and second refrigerants into a high-temperature high-pressure gaseous refrigerant, a combined condenser condensing each of the first and second refrigerants passing through the first and second compressors into a high-temperature high-pressure liquid refrigerant, first and second expansion valves phase-changing each of the first and second refrigerants passing through the combined condenser into a low-temperature low-pressure two-phase refrigerant, and first and second evaporators changing the refrigerant passing through each of the first and second expansion valves into a low-temperature low-pressure gaseous refrigerant.

13 Claims, 8 Drawing Sheets

(58) Field of Classification Search
CPC ..... F25B 2400/02; F28D 1/0316; F28D 2021/0084; F28D 1/05375; B60H 1/3227; F28F 1/022
See application file for complete search history.

(56) References Cited

U.S. PATENT DOCUMENTS 4,201,065 A 5/1980 Griffin
4,302,949 A * 12/1981 Trimboli Longhetto ..... F25B 9/04 62/235.1
4,972,683 A * 11/1990 Beatenbough ..... F25B 39/04 165/110
5,103,650 A * 4/1992 Jaster ..... F25B 1/10 62/198
5,205,130 A 4/1993 Pannell
5,531,268 A * 7/1996 Hoshino ..... F28D 1/0476 165/149
5,542,271 A * 8/1996 Kudoh ..... F25B 39/00 165/146
5,996,360 A * 12/1999 Tanaka ..... B60H 1/00907 62/159
6,006,541 A * 12/1999 Taylor ..... F25D 23/061 165/169
6,250,086 B1 * 6/2001 Cho ..... F25B 41/00 62/324.6
6,250,103 B1 * 6/2001 Watanabe ..... F25B 39/04 62/509
6,370,909 B2 * 4/2002 Watanabe ..... F25B 39/04 62/509
6,389,818 B2 * 5/2002 Cho ..... B01D 45/16 62/498
6,662,576 B1 * 12/2003 Bai ..... F25B 43/00 62/117
7,040,386 B2 * 5/2006 Shimoya ..... F28F 1/022 165/153
7,614,443 B2 * 11/2009 Usui ..... F28D 7/1684 165/177
7,669,428 B2 * 3/2010 Federov ..... F25B 9/008 62/238.2
8,099,978 B2 * 1/2012 Aung ..... F25B 5/00 62/515
9,109,821 B2 * 8/2015 Kim ..... F25B 39/04
9,175,898 B2 * 11/2015 Chae ..... F25D 17/065
9,328,973 B2 * 5/2016 Jindou ..... F28F 9/02
9,377,253 B2 * 6/2016 Hwang ..... F28F 9/0275
9,791,221 B1 * 10/2017 Litch ..... F28F 9/262
2001/0018833 A1 * 9/2001 Pozivil ..... F25J 1/0025 62/613
2004/0159120 A1 * 8/2004 Makida ..... F25B 9/006 62/500
2006/0144076 A1 7/2006 Daddis
2008/0302131 A1 * 12/2008 Higashiyama ..... F25B 39/02 62/515
2009/0084129 A1 * 4/2009 Kim ..... F25B 39/00 62/502
2009/0095003 A1 * 4/2009 Nagano ..... F25B 39/02 62/217
2009/0173102 A1 * 7/2009 Ogasawara ..... F25B 39/04 62/498
2010/0162748 A1 * 7/2010 Tso ..... F25B 29/003 62/468
2010/0229804 A1 * 9/2010 Okamoto ..... F24H 1/145 122/18.2
2011/0126581 A1 * 6/2011 Cho ..... F25B 40/02 62/507
2012/0011867 A1 * 1/2012 Koons ..... F25B 39/04 62/115
2012/0255323 A1 * 10/2012 Kim ..... F25B 13/00 62/498
2013/0067948 A1 * 3/2013 Kim ..... F25D 23/003 62/419
2013/0186604 A1 * 7/2013 Geppert ..... F28D 1/0461 165/140
2014/0007612 A1 * 1/2014 Kim ..... F25B 39/04 62/498

FOREIGN PATENT DOCUMENTS

DE 102008043920 A1 5/2010
EP 1150076 A2 * 10/2001 ..... B60H 1/3227
JP H03-152370 6/1991
JP 2007232282 A1 9/2007
KR 20090006419 1/2009
KR 10-2011-0071167 A 6/2011
KR 20110071167 A * 6/2011 ..... F25D 19/00
KR 10-2012-0012613 2/2012
NL 106 435 C 6/1963
WO WO 2012040281 A3 * 8/2012 ..... F28D 1/0461

OTHER PUBLICATIONS

European Search Report dated Mar. 25, 2015 for Application No. EP 14191730, 7 pages.
European Communication in European Application No. 14 191 730.2, dated Mar. 29, 2018, 7 pages.

* cited by examiner

REFRIGERATION CYCLE OF REFRIGERATOR

CROSS-REFERENCE TO RELATED APPLICATIONS

The present application claims the benefits of priority to Korean Patent Application No. 10-2013-0133375 filed on Nov. 5, 2013, which is herein incorporated by reference in its entirety.

BACKGROUND

The present disclosure relates to a refrigeration cycle of a refrigerator.

In refrigerator according to the related art, a refrigerant is transferred from one compressor into evaporators respectively disposed at rear sides of a refrigerating compartment and freezing compartment, and then, a valve disposed in each of the evaporators is adjusted in opening degree to alternately perform an operation for cooling the freezing compartment and the refrigerating compartment. Alternatively, a freezing compartment is cooled by using a single evaporator disposed on a side of the freezing compartment, and then cool air is transferred into a refrigerating compartment by using a damper.

However, in the case of the above-described structure, temperatures required for the refrigerating compartment and the freezing compartment are different from each other. Thus, to realize the temperatures required for the two storage compartments, which have a large temperature difference therebetween, in a refrigeration cycle including one compressor, the compressor may operate out of the optimum efficiency range thereof. To solve this limitation, a two-cycle refrigerator including a refrigeration cycle for a refrigerating compartment and a refrigeration cycle for a freezing compartment has been released.

However, in case of the two-cycle refrigerator, following limitations occurs as ever. That is, in the two cycles, one of the limitations is that two compressors and condensers have to be installed in a machine room. As a result, the machine room may increase in volume, and thus the storage compartment may be reduced in volume.

Also, if the two compressors and condensers are installed in the limited machine room, the condensers are limited in size and capacity to cause a limit in heat-dissipation area for dissipating heat.

In addition, when the two condensers and two compressors are disposed in the machine room, flow resistance of indoor air that forcibly flows into the machine room by a condensation fan to deteriorate heat-dissipation efficiency of the condensers.

To solve the above-described limitations of the refrigerator having the two refrigerant cycles, needs for developing a refrigerator that has a small size and high heat-dissipation efficiency due to the machine room having a limited volume are being on the rise.

SUMMARY

The present disclosure is proposed to achieve the above-described objects.

In one embodiment, a refrigeration cycle of a refrigerator including a first refrigeration cycle in which a first refrigerant flows along a first refrigerant tube and a second refrigeration cycle in which a second refrigerant flows along a second refrigerant tube includes: first and second compressors compressing each of the first and second refrigerants into a high-temperature high-pressure gaseous refrigerant; a combined condenser condensing each of the first and second refrigerants passing through the first and second compressors into a high-temperature high-pressure liquid refrigerant; first and second expansion valves phase-changing each of the first and second refrigerants passing through the combined condenser into a low-temperature low-pressure two-phase refrigerant; and first and second evaporators changing the refrigerant passing through each of the first and second expansion valves into a low-temperature low-pressure gaseous refrigerant, wherein the combined condenser includes: first and second condensation tubes constituting portions of the first and second refrigerant tubes that connect the first and second compressors to the first and second expansion valves, respectively; and heat-exchange fins contacting surfaces of the first and second condensation tubes, wherein the plurality of first and second condensation tubes are alternately parallely disposed in a width direction thereof.

The first and second condensation tubes that are alternately parallely disposed in the width direction thereof may be vertically bent several times to form a meander line, and the heat-exchange fins may be disposed in an inner space defined by the condensation tubes that are vertically adjacent to each other.

Each of the heat-exchange fins may have the same width as that of the combined condenser and be vertically bent or curved several times to form a plurality of upper and lower cusps that are alternately disposed.

The upper and lower cusps of the heat-exchange fin may contact surfaces of the refrigerant tubes that are vertically adjacent to each other, respectively.

The refrigeration cycle may further include: a first inflow-side head connected to inlet ends of the plurality of first condensation tubes; a first inflow port disposed on one side of the first inflow-side head; a first discharge-side head connected to outlet ends of the plurality of first condensation tubes; and a first discharge port disposed on one side of the first discharge-side head.

The refrigeration cycle may further include: a second inflow-side head connected to inlet ends of the plurality of second condensation tubes; a second inflow port disposed on one side of the second inflow-side head; a second discharge-side head connected to outlet ends of the plurality of second condensation tubes; and a second discharge port disposed on one side of the second discharge-side head.

The first and second inflow-side heads and the first and second discharge-side heads may be provided one by one.

The inflow-side head and the discharge-side head may be independently connected to the inlet ends and outlet ends of the plurality of first and second condensation tubes, respectively.

One of the first and second evaporators may be a refrigerating compartment evaporator, and the other of the first and second evaporators may be a freezing compartment evaporator.

The combined condenser and the first and second compressors may be accommodated in a machine room of the refrigerator.

The first and second refrigerants may be the same kind.

The first and second refrigerants may be heterogeneous refrigerants.

The first and second refrigerant tubes may have widths different from each other so that one of the first refrigerant tube and the second refrigerant tube has a heat-exchange area greater than that of the other of the first refrigerant tube and the second refrigerant tube.

The details of one or more embodiments are set forth in the accompanying drawings and the description below. Other features will be apparent from the description and drawings, and from the claims.

DETAILED DESCRIPTION OF THE EMBODIMENTS

Hereinafter, a refrigeration cycle of a refrigerator according to an embodiment will be described in detail with reference to the accompanying drawings.

Figure 1:
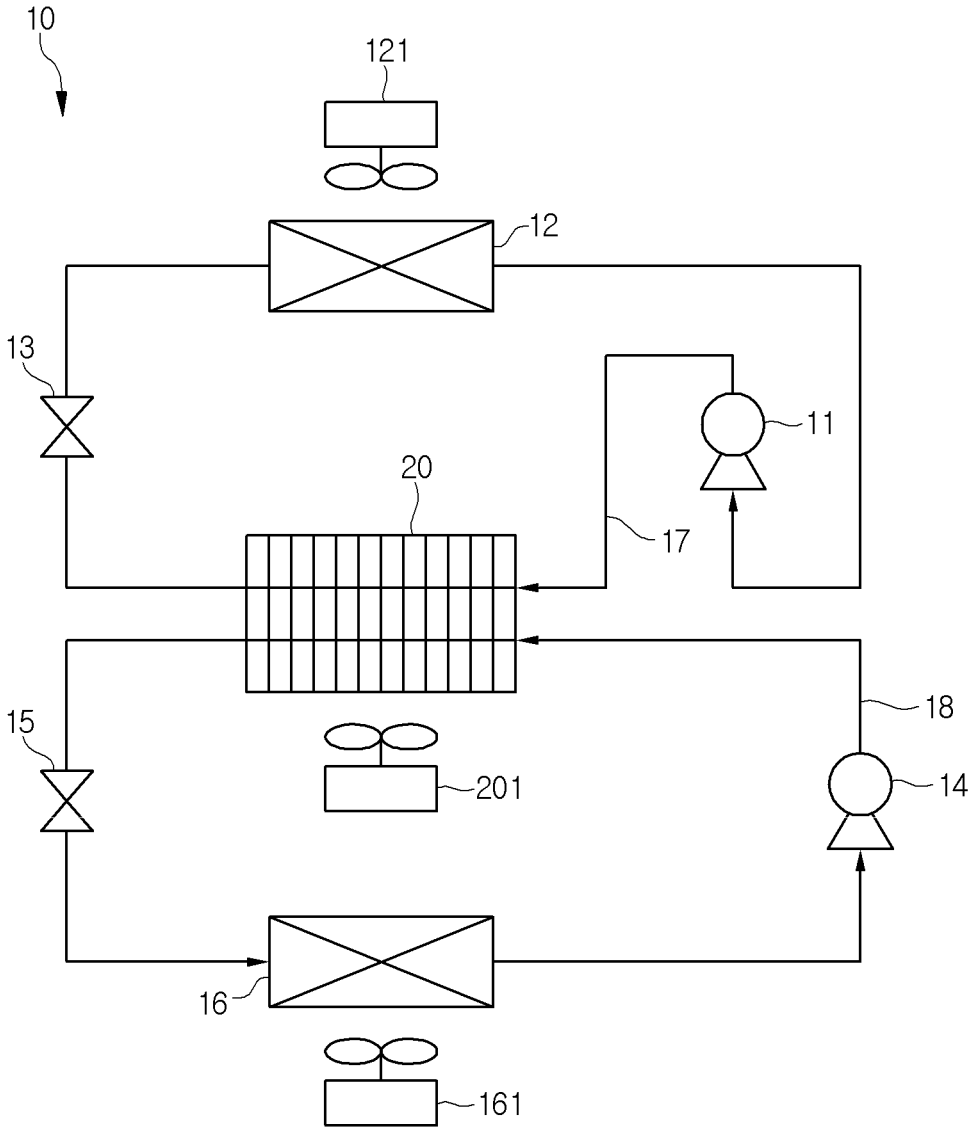
FIG. 1 is a system view illustrating a refrigeration cycle of a refrigerator according to an embodiment.

FIG. 1 is a system view illustrating a refrigeration cycle of a refrigerator according to an embodiment.

Referring to FIG. 1, a refrigeration cycle 10 of a refrigerator according to an embodiment may include a first refrigeration cycle in which a refrigerant flowing along a first refrigerant tube 17 is heat-exchanged with cool air or external air and a second refrigeration cycle in which a refrigerant flowing along a second refrigerant tube 18 is heat-exchanged with the cool air or external air. Also, a condenser of the first refrigeration cycle and a condenser of the second refrigeration cycle share heat-exchange fins. Here, the refrigerant flowing along the first refrigerant tube 17 may be defined as a first refrigerant, and the refrigerant flowing along the second refrigerant tube 18 may be defined as a second refrigerant. The first refrigerant and the second refrigerant may be the same kind.

In detail, the first refrigeration cycle may include a first compressor 11 compressing the first refrigerant into a high-temperature high-pressure gas; a second condensation part condensing the high-temperature high-pressure first refrigerant passing through the first compressor 11 into a high-temperature high-pressure liquid refrigerant; a first expansion valve 13 phase-changing the high-temperature high-pressure liquid refrigerant passing through the second condensation part into a low-temperature low-pressure two-phase refrigerant; and a first evaporator 12 absorbing heat of the refrigerant passing through the first expansion valve 13 to generate a gaseous refrigerant.

Also, the second refrigeration cycle may include a second compressor 14 compressing the second refrigerant, a second condensation part condensing the second refrigerant, a second expansion valve 15 phase-changing the second refrigerant, and a second evaporator 16.

Here, the first condensation part and the second condensation part may be defined as a combined condenser 20 because the first and second condensation parts respectively include separate refrigerant tubes and share the heat-exchange fins. Also, the first compressor 11, the second compressor 14, and the combined condenser 20 may be disposed in a machine room of the refrigerator. A condensation fan 201 may be disposed at a point that is spaced apart from the combined condenser 20. The condensation fan 201 may be disposed on a position at which air forcibly flowing by the condensation fan 201 passes through a gap defined between the heat-exchange fins of the combined condenser 20 and then is discharged to the outside of the machine room.

Also, the first evaporator 12 may be an evaporator for cooling one of the refrigerating compartment and freezing compartment of the refrigerator. The first evaporator 12 may be disposed on a rear wall of one of the refrigerating compartment and the freezing compartment, and a first evaporation fan 121 may be disposed above or under the first evaporator 12. Also, the second evaporator 16 may be an evaporator for cooling the other of the refrigerating compartment and freezing compartment of the refrigerator. The first evaporator 16 may be disposed on a rear wall of the other of the refrigerating compartment and the freezing compartment, and a second evaporation fan 161 may be disposed above or under the second evaporator 16.

Figure 2:
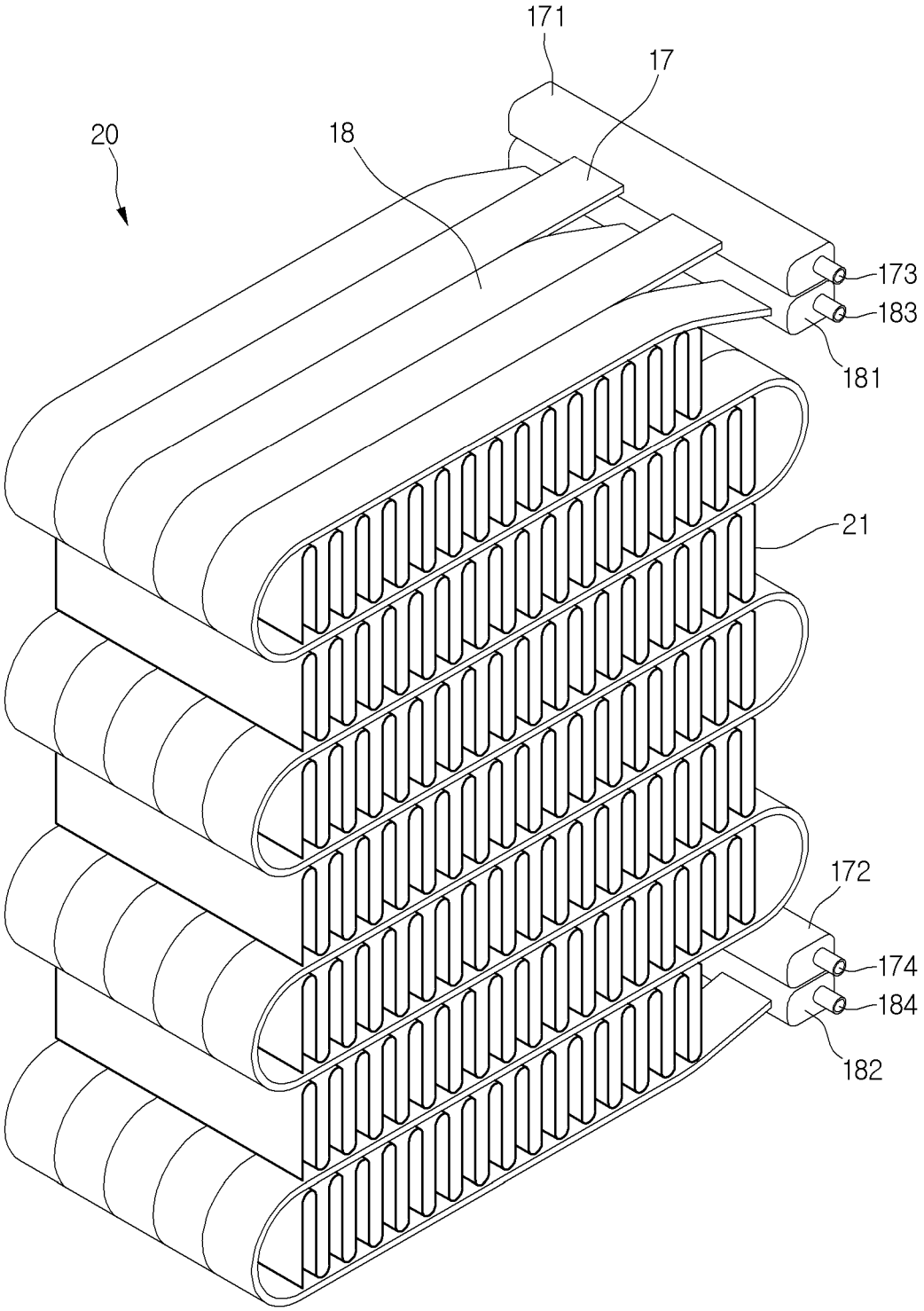
FIG. 2 is a perspective view illustrating an exterior of a combined condenser according to a first embodiment.
Figure 3:
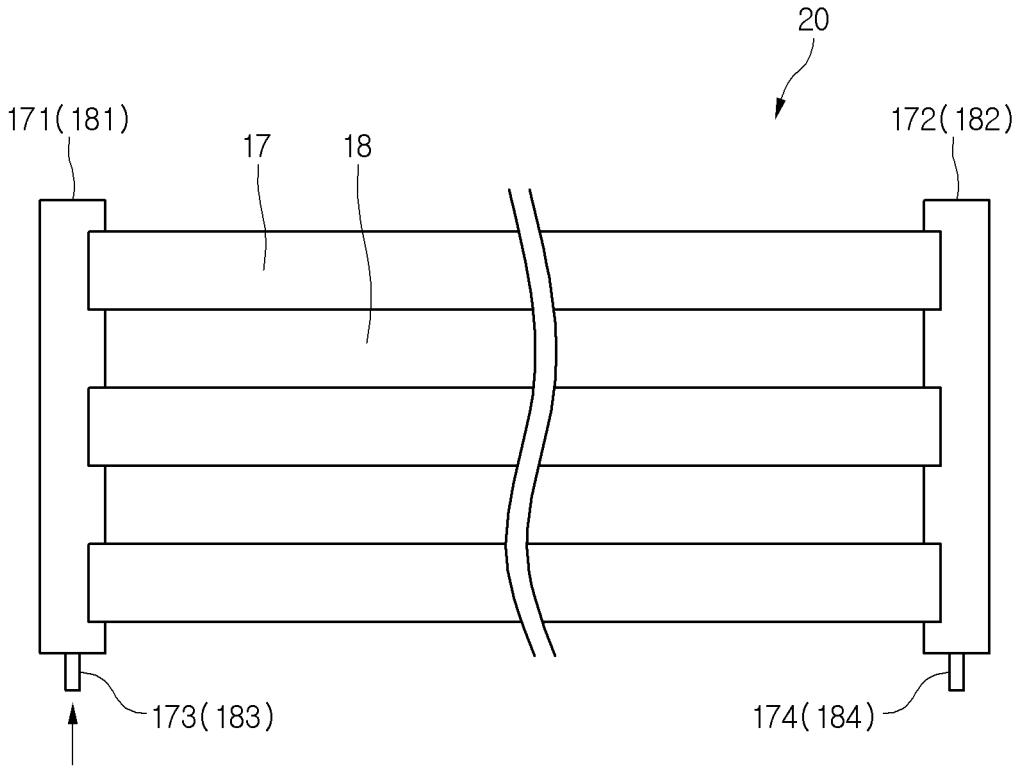
FIG. 3 is a plan view of the combined condenser when viewed in a state where a refrigerant tube is spread horizontally.
Figure 4:
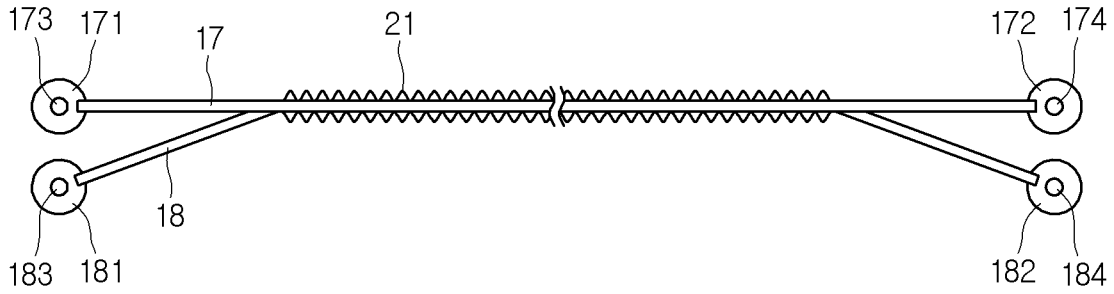
FIG. 4 is a side view of the combined condenser when viewed in the state where the refrigerant tube is spread horizontally.
Figure 5:
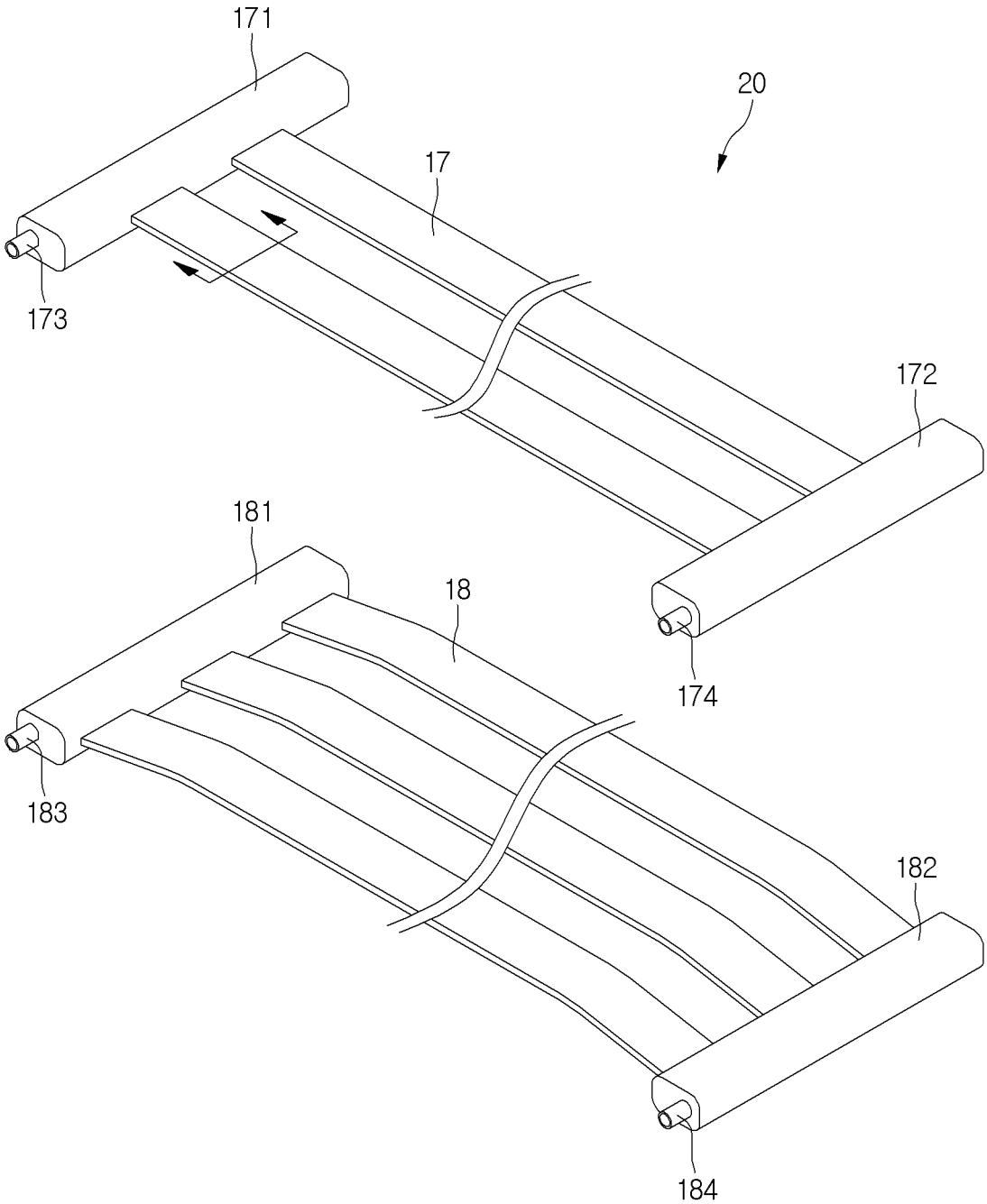
FIG. 5 is an exploded perspective view of the combined condenser when viewed in the state where the refrigerant tube is spread horizontally.

FIG. 2 is a perspective view illustrating an exterior of a combined condenser according to a first embodiment, FIG. 3 is a plan view of the combined condenser when viewed in a state where a refrigerant tube is spread horizontally, FIG. 4 is a side view of the combined condenser when viewed in the state where the refrigerant tube is spread horizontally, and FIG. 5 is an exploded perspective view of the combined condenser when viewed in the state where the refrigerant tube is spread horizontally.

Referring to FIGS. 2 to 5, a combined condenser 20 according to a first embodiment may include a plurality of first refrigerant tubes 17 into which a first refrigerant flows and connected to each other in parallel, a plurality of second refrigerant tubes 18 into which a second refrigerant flows and connected to each other in parallel, and heat-exchange fins 21 contacting surface of the refrigerant tubes 17 and 18 that are connected to each other in parallel. Also, the plurality of first refrigerant tubes 17 and second refrigerant tubes 18 are alternately disposed adjacent to each other in a width direction thereof to form a meander line that is bent several times in an S shape. The combined condenser 20 may have a height that is determined by the bent number of the refrigerant tubes and a curvature of the bent portion. That is, the more the bent portion increases in curvature, the more a distance between the refrigerant tubes vertically adjacent to each other increases. Thus, the combined condenser 20 may increase in height. In addition, the bent number increases, the more the combined condenser 20 increases in height. Here, portions of the first and second refrigerant tubes 17 and 18 contacting the heat exchange fins 21, i.e., portions of the tubes constituting the combined condenser 20 may be defined as first and second condensation tubes.

Also, the heat-exchange fins 21 are inserted into a space defined between the refrigerant tubes that are vertically adjacent to each other. Also, the heat-exchange fins 21 may have a width corresponding to the total width of the refrigerant tubes 17 and 18 that are disposed adjacent to each other and be curved or bent several times to form a plurality of upper and lower cusps. Also, the plurality of upper and lower cusps may contact the surfaces of the refrigerant tubes that are vertically adjacent to each other to transfer heat from the refrigerant tubes to the heat-exchange fins. According to the design conditions, as illustrated in FIG. 2, the heat-exchange fins are not formed at the bent portions of the refrigerant tubes. Also, each of the heat-exchange fins 21 may be provided as a thin film sheet having high thermal conductivity. Also, the heat-exchange fins 21 may be divided into a first heat-exchange area that is heat-exchanged with the first refrigerant tube 17 and a second heat-exchange area that is heat-exchanged with the second refrigerant tube 18, which contact the surfaces of the refrigerant tubes 17 and 18.

Inflow-side heads 171 and 181 may be respectively connected to inlet ends of the first and second refrigerant tubes 17 and 18, and discharge-side heads 172 and 182 may be respectively connected to outlet ends of the first and second refrigerant tubes 17 and 18. Also, inflow ports 173 and 183 through which the refrigerant is introduced may be respectively disposed on one side of the inflow-side heads 171 and 181, and discharge ports 174 and 184 through which the refrigerant is discharged may be respectively disposed on the discharge-side heads 172 and 182.

Also, as illustrated in FIG. 4, the inflow-side head 171 of the first refrigerant tube 17 and the inflow-side head 181 of the second refrigerant tube 18 and also the discharge-side head 172 of the first refrigerant tube 17 and the discharge-side head 182 of the second refrigerant tube 18 may be vertically disposed with a height difference therebetween to prevent the inflow-side heads 171 and 181 and the discharge-side heads 172 and 182 from interfering with each other. For this, both ends of one of the first and second refrigerant tubes 17 and 18 may be designed to be bent upward or downward. Also, portions of the refrigerant tube that extend horizontally may be disposed on the same horizontal surface. Also, when viewed from one side, only the forefront refrigerant tube may be seen. Also, the portions of the refrigerant tubes, which are disposed on the same horizontal surface, may be bent several times in one body to form the shape of the combined condenser 20 as illustrated in FIG. 2.

The first and second refrigerants discharged from the first and second compressors 11 and 14 may be introduced into the inflow-side heads 171 and 181 through the inflow ports 173 and 183, respectively. Then, the refrigerant introduced into the inflow-side heads 171 and 181 may be divided into the plurality of refrigerant tubes 17 and 18 to flow. Also, the first and second refrigerants may be collected into the discharge-side heads 172 and 182 to flow into the first and second expansion valves 13 and 15 through the discharge ports 174 and 184.

Also, when only one of the first and second refrigeration cycles operates, a high-temperature high-pressure refrigerant may flow into only one tube of the first and second refrigerant tubes 17 and 18. Thus, heat may be transferred into a portion of the heat-exchange fins that correspond to one area of the first and second heat-exchange areas. Here, since the first and second refrigerant tubes 17 and 18 are alternately disposed in a width direction of the combined condenser 20, the first and second heat-exchange areas may be alternately disposed in the width direction of the heat-exchange fins 21. However, since the heat-exchange fins 21 have continuous one fin structure in the width direction thereof, even though the high-temperature high-pressure refrigerant flows into only one tube of the first and second refrigerant tubes 17 and 18, heat may be transferred into the heat-exchange fin that corresponds to a region in which the refrigerant does not flow to perform the heat-exchange operation.

In addition, since the plurality of first and second heat-exchange areas are alternately formed, a ratio or area of a portion of the heat-exchange fin contacting the tube in which the refrigerant does not flow to a portion of the heat-exchange fin participating in the heat-exchange operation increases. This may represent that the heat-exchange efficiency through the heat-exchange fins gradually increases.

That is, under the same condition as the total width of the refrigerant tube according to an embodiment, it may assume a condenser structure, in which the first and second refrigerant tubes 17 and 18 are provided as a single tube and disposed parallel to each other in a lateral direction on the same plane, through the total width of the refrigerant tubes.

Thus, when only the first refrigeration cycle operates, even though heat is transferred from the first heat-exchange area that is heat-exchanged with the first refrigerant tube 17 to the second heat-exchange area that is heat-exchanged with the second refrigerant tube 18, the heat transfer area may not be wide. According to experiment results, it is seen that an area through which the heat is transferred from a boundary between the first and second heat-exchange areas is below about 30% of the entire area of the second heat-exchange area. That is to say, a ratio of the width of the heat-exchange fin 21, through which heat is transferred from the first heat-exchange area, to the width of the heat-exchange fin 21 defining the second heat-exchange area may be below about 30%.

However, according to the current embodiment, each of the first and second heat-exchange areas may be divided into a plurality of sections to narrow a width thereof. In addition, the first and second heat-exchange areas may be alternately disposed. Thus, a relatively large amount of heat may be transferred to the heat-exchange fin contacting the refrigerant tube that is in an operation stop state. According to the experiment results, it is seen that a heat transfer area from the first heat-exchange area to the second heat-exchange area reaches about 89% of the entire area of the second heat-exchange area. This represents that the combined condenser increases in condensation performance as the availability increases.

Figure 6:
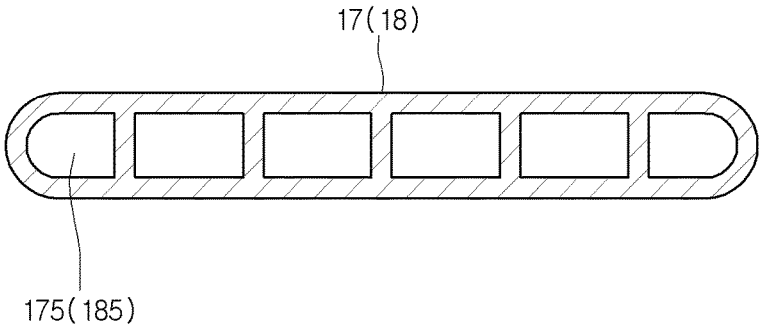
FIG. 6 is a cross-sectional view of a refrigerant tube constituting a combined condenser according to an embodiment.

FIG. 6 is a cross-sectional view of a refrigerant tube constituting a combined condenser according to an embodiment.

Referring to FIG. 6, each of refrigerant tubes 17 and 18 constituting a combined condenser 20 according to an embodiment may have a plate shape with a predetermined width. Also, each of the refrigerant tubes 17 and 18 may have a multi-channel refrigerant tube structure in which a plurality of refrigerant flow channels 175 and 185 are formed.

In detail, since the refrigerant tube is partitioned into the plurality of channels, an area of the refrigerant tube that is heat-exchanged with the refrigerant may increase to quickly transfer heat into the heat-exchange fins 21. That is, heat may be quickly transferred to an outer surface of the refrigerant tube through a partition wall partitioning the channels adjacent to each other.

Figure 7:
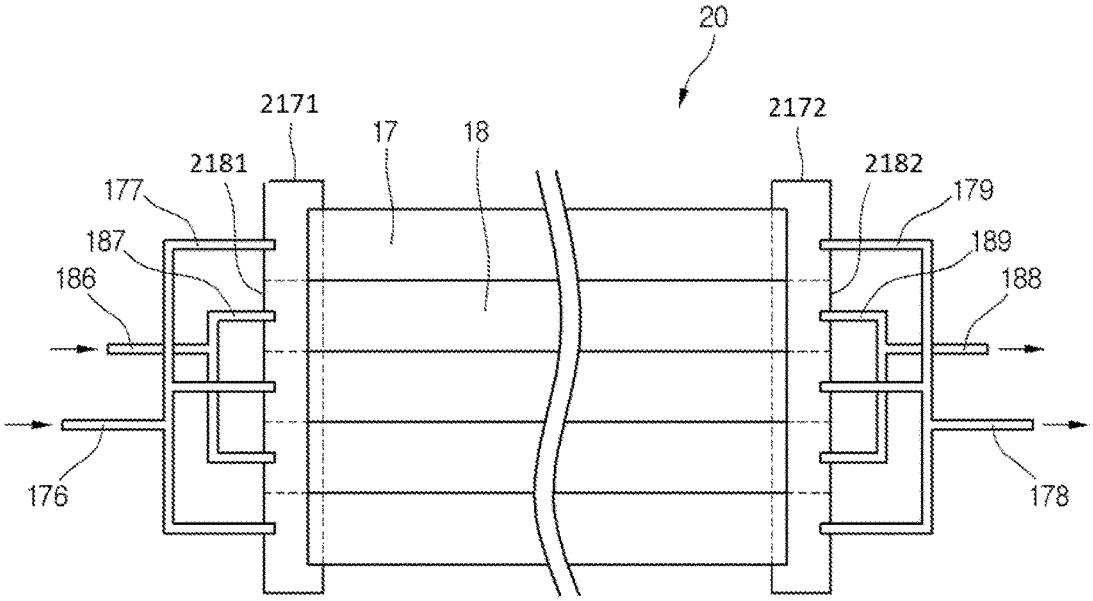
FIG. 7 is a plan view of a combined condenser when viewed in a state where a refrigerant tube of the combined condenser is spread horizontally according to a second embodiment.
Figure 8:
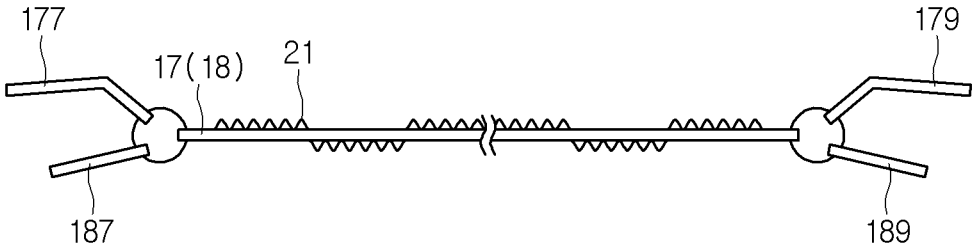
FIG. 8 is a side view of the combined condenser when viewed in the state where the refrigerant tube is spread horizontally.
Figure 9:
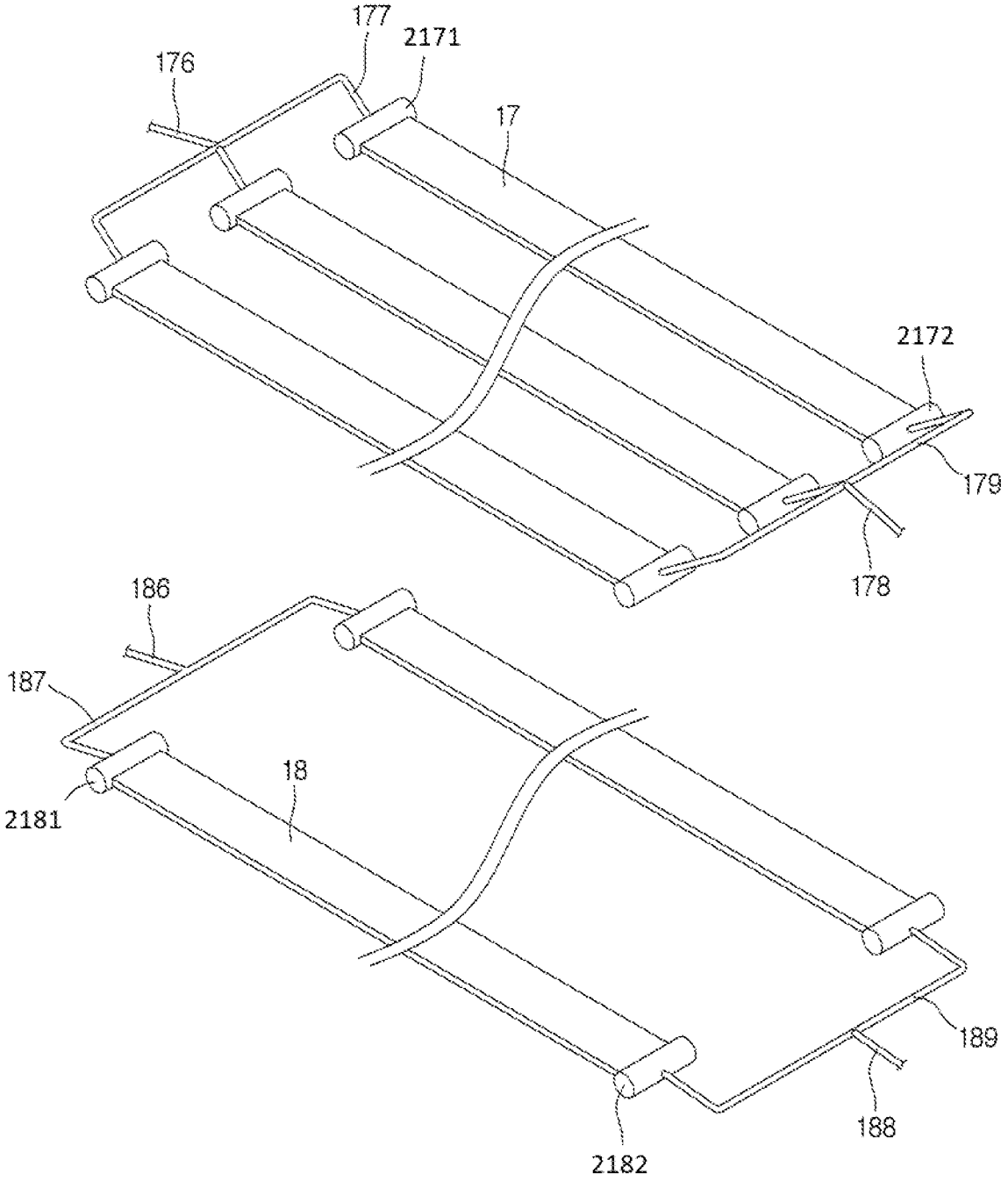
FIG. 9 is an exploded perspective view of the combined condenser when viewed in the state where the refrigerant tube is spread horizontally.

FIGS. 7 to 9 are views illustrating a refrigerant tube structure of a combined condenser according to a second embodiment. That is, FIG. 7 is a plan view of the combined condenser when viewed in a state where a refrigerant tube of the combined condenser is spread horizontally according to the second embodiment, FIG. 8 is a side view of the combined condenser when viewed in the state where the refrigerant tube is spread horizontally, and FIG. 9 is an exploded perspective view of the combined condenser when viewed in the state where the refrigerant tube is spread horizontally.

The structure of the combined condenser 20 according to the current embodiment may be equal to the shape of the condenser 20 (see FIG. 2) according to the first embodiment except for a configuration of a head.

In detail, the combined condenser 20 according to the current embodiment includes a plurality of first refrigerant tube 17 and second refrigerant tubes 18, like the first embodiment. The plurality of first and second refrigerant tubes 17 and 18 may be alternately disposed in parallel to each other on the same plane. Also, the refrigerant tube according to the current embodiment is equal to that of the first embodiment in that the refrigerant tubes that are disposed parallel to each other on the same plane are bent several times to form a meander line.

However, the current embodiment is different from the first embodiment in that heads are respectively connected to inlet ends and outlet ends of refrigerant tubes that are divided into a plurality of refrigerant tubes. That is, an inflow-side head 2171 and discharge-side head 2172 are connected to the inlet end and outlet end of each of the plurality of first refrigerant tubes 17. This is the same in the case of the second refrigerant tube 18. Also, the inflow-side heads 2171 of the first refrigerant tube 17 and the inflow-side heads 2181 of the second refrigerant tube 18 may be alternately disposed in one straight line. Also, a plurality of distribution tubes 177 and 187 that corresponding to the number of inflow-side heads 2171 and 2181 may be branched from the inflow ports 176 and 186, and discharge ends of the distribution tubes 177 and 187 may be respectively connected to the inflow-side heads 2171 and 2181. This may be equally applied to the discharge-side heads. That is, the discharge-side head 2172 connected to the outlet end of the first refrigerant tube 17 and the discharge-side head 2182 connected to the outlet end of the second refrigerant tube 18 are disposed in one straight line. Also, the distribution tubes 179 and 189 may be connected to the discharge-side heads 2172 and 2182, respectively and may be concentrated into the discharge ports 178 and 188, respectively.

For another example, a single inflow-side head may be applied, and a plurality of partition walls may be provided in the head. Also, a first refrigerant inflow-side head and a second refrigerant inflow-side head may be alternately disposed. This may be equally applied to the discharge-side head.

According to the above-described structure, it may be unnecessary that the inlet ends and outlet ends of the refrigerant tubes 17 and 18 are bent upward or downward as shown in the first embodiment.

Since other heat-exchange operations are the same as those of the first embodiment, their duplicated descriptions will be omitted.

Figure 10:
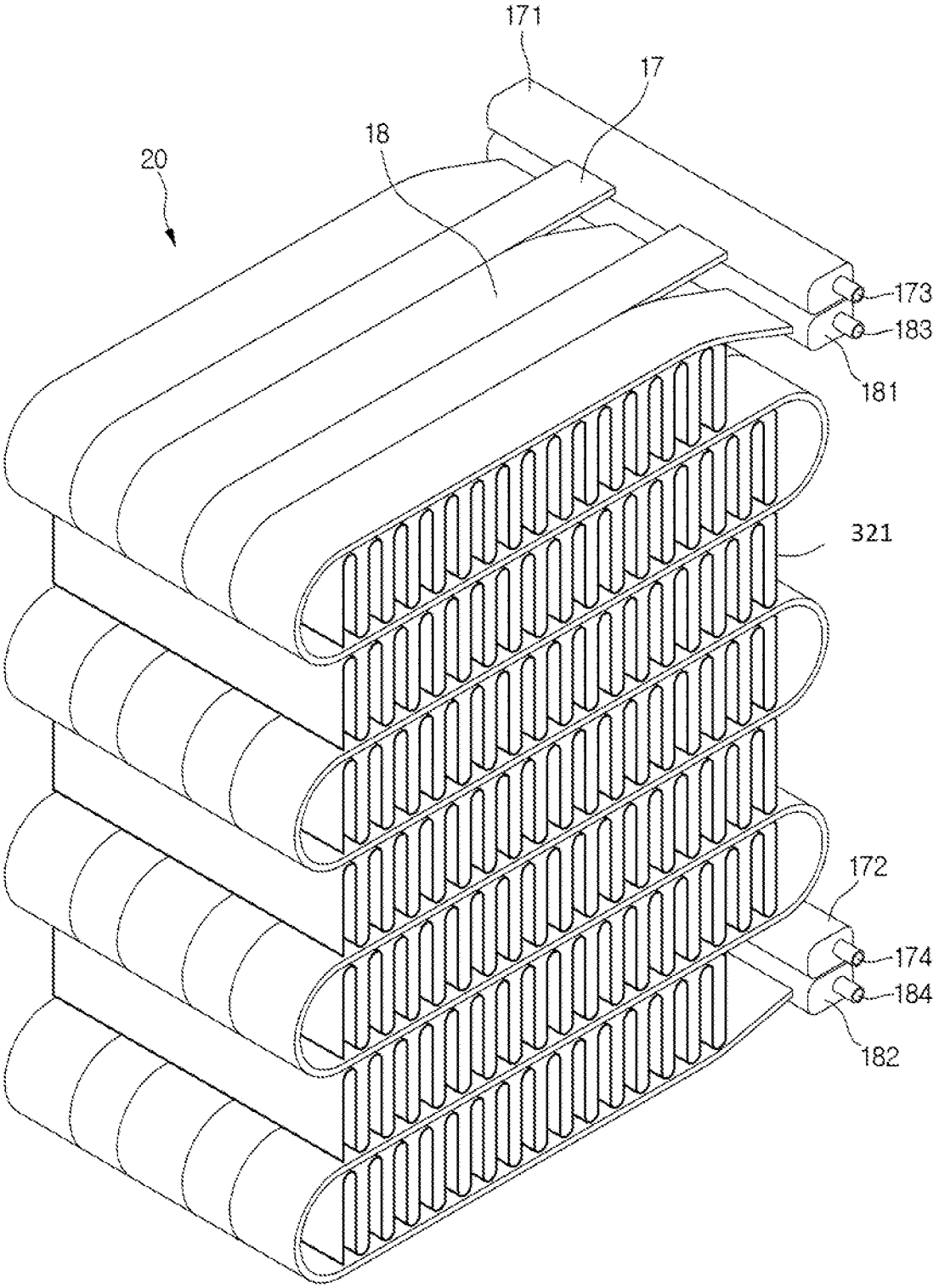
FIG. 10 is a perspective view of a combined condenser according to a third embodiment.

FIG. 10 is a perspective view of a combined condenser according to a third embodiment.

Referring to FIG. 10, a condenser 20 according to the current embodiment is different from those according to the foregoing embodiments in that heat-exchange fins have heights different from each other.

In detail, a refrigeration cycle for cooling a freezing compartment and a refrigeration cycle for cooling a refrigerating compartment are differently designed in capacity of a compressor and size of an evaporator. That is to say, since cooling performance required for cooling the freezing compartment is greater than cooling performance required for cooling the refrigerating compartment, a freezing compartment evaporator may have a size greater than that of a refrigerating compartment evaporator.

In this aspect, a heat-exchange area of a condenser for cooling the freezing compartment may be greater than that of a condenser for cooling the refrigerating compartment. That is, a heat-exchange area of a heat-exchange fin contacting a refrigerant tube for cooling the freezing compartment may be greater than that of a heat-exchange fin contacting a refrigerant tube for cooling the refrigerating compartment.

In detail, in the structure of the combined condenser 20 according to an embodiment, since the first refrigerant tube 17 and the second refrigerant tube 18 share the same heat-exchange fin 321, the heat-exchange fin 321 may be changed in shape to change the heat-exchange area.

Thus, if it is assumed that the first refrigerant tube 18 is the refrigeration cycle for the refrigerating compartment, and the second refrigerant tube 18 is the refrigeration cycle for the freezing compartment, the second refrigerant tube 18 may have a width greater than that of the first refrigerant tube 17 to change the heat-exchange area.

According to the refrigeration cycle of the refrigerator according to the embodiment, the following effects can be obtained.

First, the single-type condenser structure may be adopted for the refrigerator having the two refrigeration cycles to improve use efficiency of the machine room.

Second, in the two-cycle structure, the two condensers may be changed in design into the single-type condenser to relatively widen the inner space of the machine room. Thus, the flow resistance of the air for the heat dissipation may be reduced in the machine MOM.

Third, in the condenser structure according to the embodiment, since the two independent condensation refrigerant tubes share the heat-exchange fin, utilization efficiency of the heat-exchange fin may increase when compared to a case in which the two condensers are disposed in parallel to each other.

That is to say, in the structure in which the two independent condensers are disposed in parallel to each other, if only one of the two cycles operates, the heat-change fin of the condenser in the refrigeration cycle that does not operate may not perform the heat-dissipation operation.

However, according to the embodiment, since the two independent condensation tubes share at least one portion of the heat-exchange fins, even though only one refrigeration cycle operates, the whole heat-exchange fins contacting the condensation tube in which the refrigerant flows may perform the heat-dissipation operation. Thus, the heat-dissipation amount of the condenser may increase to improve the heat-dissipation efficiency.

Fourth, the refrigerant tubes constituting the separate refrigeration cycle may be divided into a plurality of refrigerant tubes, and the divided refrigerant tubes may be alternately disposed on the same plane. Also, the heat-exchange fins may be disposed on the surfaces of the refrigerant tubes. Thus, the heat transferred into the heat-exchange fins contacting the surfaces of the refrigerant tubes during the operation may be conducted into the heat-exchange fins contacting the surface of the refrigerant tubes that is in the operation stop state. Thus, all of the heat-exchange fins may participate in the heat-exchange operation to improve the heat-exchange efficiency.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigeration cycle of a refrigerator comprising a first refrigeration cycle in which a first refrigerant flows along a first refrigerant tube and a second refrigeration cycle in which a second refrigerant flows along a second refrigerant tube, the first refrigeration cycle being independent from the second refrigeration cycle, and the refrigeration cycle comprising:

a first compressor configured to compress the first refrigerant into a high-temperature high-pressure gaseous refrigerant;

a second compressor configured to compress the second refrigerant into a high-temperature high-pressure gaseous refrigerant;

a combined condenser that is configured to condense each of the first refrigerant passing through the first compressor and the second refrigerant passing through the second compressor into a high-temperature high-pressure liquid refrigerant by dissipating heat;

a first expansion valve configured to cause a phase-change of the first refrigerant passing through the combined condenser into a low-temperature low-pressure two-phase refrigerant;

a second expansion valve configured to cause a phase-change of the second refrigerant passing through the combined condenser into a low-temperature low-pressure two-phase refrigerant;

a first evaporator configured to change the first refrigerant passing through the first expansion valve into a low-temperature low-pressure gaseous refrigerant by absorbing heat; and a second evaporator configured to change the second refrigerant passing through the second expansion valve into a low-temperature low-pressure gaseous refrigerant by absorbing heat, wherein the combined condenser comprises:

a first inflow side head in which the first refrigerant is introduced;

a first discharge side head from which the first refrigerant is discharged, the first discharge side head being laterally disposed vertically below the first inflow side head, a second inflow side head in which the second refrigerant is introduced;

a second discharge side head from which the second refrigerant is discharged, the second discharge side head being disposed vertically below the second inflow side head;

a plurality of first condensation tubes that are portions of the first refrigerant tube and that constitute the first refrigeration cycle, each first condensation tube having a flat plate shape, defining a plurality of flow channels at an interior thereof, and connecting the first inflow side head and the first discharge side head;

a plurality of second condensation tubes that are portions of the second refrigerant tube and that constitute the second refrigeration cycle, each second condensation tube having a flat plate shape, defining a plurality of flow channels at an interior thereof, and connecting the second inflow side head and the second discharge side head; and a plurality of heat-exchange fins that contact surfaces of the plurality of first and second condensation tubes, wherein the plurality of first condensation tubes extend from the first inflow side head, wherein the plurality of first condensation tubes are spaced apart from each other along the first inflow side head and connected to each other in parallel by the first inflow side head, wherein the plurality of second condensation tubes extend from the second inflow side head, wherein the plurality of second condensation tubes are spaced apart from each other along the second inflow side head and connected to each other in parallel by the second inflow side head, wherein the plurality of first and the second condensation tubes share the plurality of heat-exchange fins, wherein the plurality of first and second condensation tubes are parallely disposed on a same plane and vertically bent several times to form a meander line, wherein the plurality of first and second condensation tubes are disposed alternately in a width direction of the plurality of first and second condensation tubes, wherein at least one of the plurality of first condensation tubes is disposed in a space defined between two of the plurality of second condensation tubes, wherein each of the plurality of heat-exchange fins is disposed within an inner space defined by the surfaces of the plurality of first and second condensation tubes that are vertically adjacent to each other, wherein each of the plurality of heat-exchange fins extends in the width direction by a total width of the plurality of first and second condensation tubes, and is vertically bent or curved several times to form a plurality of upper and lower cusps that are alternately disposed in the inner space and contact the surfaces of the plurality of first and second condensation tubes that are vertically adjacent to each other, and wherein each of the plurality of heat-exchange fins is configured to share all of the plurality of first and second condensation tubes that are disposed on the same plane.

2. The refrigeration cycle according to claim 1, further comprising:

a first inflow port disposed on one side of the first inflow side head; and a first discharge port disposed on one side of the first discharge side head.

3. The refrigeration cycle according to claim 2, further comprising:

a second inflow port disposed on one side of the second inflow side head; and a second discharge port disposed on one side of the second discharge side head.

4. The refrigeration cycle according to claim 1, wherein the first and second refrigerants are a same substance.

5. The refrigeration cycle according to claim 1, wherein the first and second refrigerants are heterogeneous refrigerants.

6. The refrigeration cycle according to claim 1, wherein a width of each of the plurality of first condensation tubes is different from a width of each of the plurality of second condensation tubes.

7. A refrigeration cycle of a refrigerator comprising a first refrigeration cycle in which a first refrigerant flows along a first refrigerant tube and a second refrigeration cycle in which a second refrigerant flows along a second refrigerant tube, the first refrigeration cycle being independent from the second refrigeration cycle, and the refrigeration cycle comprising:

a first compressor configured to compress the first refrigerant;

a second compressor configured to compress the second refrigerant;

a combined condenser that is connected to the first compressor by the first refrigerant tube and configured to condense the first refrigerant passing through the first compressor, and that is connected to the second compressor by the second refrigerant tube and configured to condense the second refrigerant passing through the second compressor;

a first expansion valve that is connected to the combined condenser by the first refrigerant tube and that is configured to cause a phase-change of the first refrigerant passing through the combined condenser;

a second expansion valve that is connected to the combined condenser by the second refrigerant tube and that is configured to cause a phase-change of the second refrigerant passing through the combined condenser;

a first evaporator connected to the first expansion valve by the first refrigerant tube and configured to allow the first refrigerant to absorb heat; and a second evaporator connected to the second expansion valve by the second refrigerant tube and configured to allow the second refrigerant to absorb heat, wherein the combined condenser comprises:

a plurality of first inflow side heads that are configured to receive the first refrigerant, respectively, that are disposed in a first straight line, and that are spaced apart from each other along the first straight line;

a plurality of first discharge side heads that are configured to discharge the first refrigerant, respectively, that are disposed in a second straight line, and that are spaced apart from each other along the second straight line;

a plurality of second inflow side heads that are configured to receive the second refrigerant, respectively, and that are disposed in one straight line;

a plurality of second discharge side heads that are configured to discharge the second refrigerant, respectively, and that are disposed in one straight line;

a plurality of first condensation tubes that are portions of the first refrigerant tube, that are spaced apart from each other along the plurality of first inflow side heads, and that constitute the first refrigeration cycle, each first condensation tube having a flat plate shape, defining a plurality of flow channels at an interior thereof, and connecting one of the first inflow side heads to one of the first discharge side heads;

a plurality of second condensation tubes that are portions of the second refrigerant tube, that are spaced apart from each other along the plurality of second inflow side heads, and that constitute the second refrigeration cycle, each second condensation tube having a flat plate shape, defining a plurality of flow channels at an interior thereof, and connecting one of the second inflow side heads to one of the second discharge side heads;

a plurality of heat-exchange fins that contact surfaces of the plurality of first and second condensation tubes;

a plurality of first inflow side distribution tubes that are connected to the plurality of first inflow side heads, respectively;

a plurality of first discharge side distribution tubes that are connected to the plurality of the first discharge side heads, respectively;

a plurality of second inflow side distribution tubes that are connected to the plurality of second inflow side heads, respectively;

a plurality of second discharge side distribution tubes that are connected to the plurality of the second discharge side heads, respectively;

a first inflow port from which the plurality of first inflow side distribution tubes are branched;

a first discharge port to which the plurality of first discharge side distribution tubes are concentrated;

a second inflow port from which the plurality of second inflow side distribution tubes are branched; and a second discharge port to which the plurality of second discharge side distribution tubes are concentrated, wherein the plurality of first condensation tubes and the plurality of second condensation tubes are alternately disposed along the first straight line or the second straight line, wherein at least one of the plurality of first condensation tubes is disposed in a space defined between two of the plurality of second condensation tubes, wherein each of the plurality of first condensation tubes has:

a first end connected to one of the plurality of first inflow side heads, and a second end connected to one of the plurality of first discharge side heads, and wherein each of the plurality of second condensation tubes has:

a first end connected to one of the plurality of second inflow side heads, and a second end connected to one of the plurality of second discharge side heads.

8. The refrigeration cycle according to claim 7, wherein the plurality of first inflow side heads and the plurality of second inflow side heads are disposed in the first straight line.

9. The refrigeration cycle according to claim 8, wherein the plurality of first discharge side heads and the plurality of second discharge side heads are disposed in the second straight line.

10. The refrigeration cycle according to claim 7, wherein the plurality of first inflow side heads are portions of a first single inflow side head partitioned by a plurality of partition walls, and wherein the plurality of second inflow side heads are portions of a second single inflow side head partitioned by a plurality of partition walls.

11. The refrigeration cycle according to claim 10, wherein the plurality of first discharge side heads are portions of a first single discharge side head partitioned by a plurality of partition walls, and wherein the plurality of second discharge side heads are portions of a second single discharge side head partitioned by a plurality of partition walls.

12. The refrigeration cycle according to claim 7, wherein the plurality of first inflow side heads are vertically apart from the plurality of second inflow side heads.

13. The refrigeration cycle according to claim 12, wherein the plurality of first discharge side heads are vertically apart from the plurality of second discharge side heads.

* * * * *